US009453666B2

(12) United States Patent
Alabdulkarem

(10) Patent No.: US 9,453,666 B2
(45) Date of Patent: Sep. 27, 2016

(54) FLUID SYSTEM FOR HOT AND HUMID CLIMATES

(71) Applicant: Abdullah Alabdulkarem, Hyattsville, MD (US)

(72) Inventor: Abdullah Alabdulkarem, Hyattsville, MD (US)

(73) Assignee: KING SAUD UNIVERSITY, Riyadh (SA)

( * ) Notice: Subject to any disclaimer, the term of this patent is extended or adjusted under 35 U.S.C. 154(b) by 699 days.

(21) Appl. No.: 13/737,982

(22) Filed: Jan. 10, 2013

(65) Prior Publication Data

US 2014/0190194 A1 Jul. 10, 2014

(51) Int. Cl.

| | |
|---|---|
| ***F25B 27/00*** | (2006.01) |
| ***F25B 30/02*** | (2006.01) |
| ***F25B 6/04*** | (2006.01) |
| *F25B 40/00* | (2006.01) |
| *F24F 5/00* | (2006.01) |

(52) U.S. Cl.

CPC ..... *F25B 30/02* (2013.01); *F25B 6/04* (2013.01); *F25B 27/005* (2013.01); *F24F 5/0014* (2013.01); *F24F 2203/028* (2013.01); *F24F 2203/1032* (2013.01); *F24F 2203/1036* (2013.01); *F25B 40/00* (2013.01); *F25B 2400/0403* (2013.01)

(58) Field of Classification Search

CPC ..... F02B 6/04; F02B 2400/0403; F24F 2203/1032; F24F 2203/1036

See application file for complete search history.

(56) References Cited

U.S. PATENT DOCUMENTS

| | | | | |
|---|---|---|---|---|
| 3,889,742 | A * | 6/1975 | Rush | F24F 5/0046 165/236 |
| 4,100,763 | A | 7/1978 | Brody | |
| 4,180,126 | A | 12/1979 | Rush et al. | |
| 4,222,244 | A | 9/1980 | Meckler | |
| 4,256,475 | A * | 3/1981 | Schafer | F25B 30/02 62/238.7 |
| 4,700,550 | A | 10/1987 | Rhodes | |
| 4,786,301 | A | 11/1988 | Rhodes | |
| 5,131,238 | A | 7/1992 | Meckler | |
| 5,269,153 | A * | 12/1993 | Cawley | F25B 6/04 62/238.7 |
| 5,373,704 | A | 12/1994 | McFadden | |
| 6,751,964 | B2 | 6/2004 | Fischer | |
| 6,915,655 | B2 | 7/2005 | Lee et al. | |

(Continued)

OTHER PUBLICATIONS

Henning H-M., et al., "The potential of solar energy use in desiccant cooling cycles", International Journal of Refrigeration, 24 24 (2001), pp. 220-229.

(Continued)

*Primary Examiner* — Orlando Aviles Bosques

(74) *Attorney, Agent, or Firm* — Oblon, McClelland, Maier & Neustadt, L.L.P

(57) ABSTRACT

A cooling system may include a desiccant wheel with a first section and a second section. An intake air supply may be connected to the first section, and an exhaust air supply may be connected to the second section. A heat pump may be provided and include a compressor, a first condenser, a second condenser, a third condenser, an expansion device, a control valve, and an evaporator. A high temperature fluid line may be provided and include a solar panel, a fluid tank, and at least one heat exchanger. One of the second condenser and the third condenser may provide heat to the fluid tank of the high temperature fluid line. The first condenser and the at least one heat exchanger may be disposed in the exhaust air supply to heat air which regenerates desiccant material as it passes through the second section. The regenerated desiccant material removes moisture from the intake air passing through the first section.

8 Claims, 5 Drawing Sheets

(56) References Cited

U.S. PATENT DOCUMENTS

| | | | | |
|---|---|---|---|---|
| 7,654,101 | B2 | 2/2010 | Shapiro | |
| 2005/0252229 | A1 | 11/2005 | Moratalla | |
| 2006/0010906 | A1* | 1/2006 | Taras | F24F 3/153 62/513 |
| 2006/0179874 | A1* | 8/2006 | Barger | F25B 6/04 62/506 |
| 2010/0242517 | A1* | 9/2010 | Johnson | F25B 30/06 62/259.4 |
| 2010/0275629 | A1 | 11/2010 | Erickson | |
| 2011/0056200 | A1 | 3/2011 | Soothill et al. | |

OTHER PUBLICATIONS

Enteria N., et al., "Construction and initial operation of the combined solar thermal and electric desiccant cooling system", Solar Energy 83 (2009), pp. 1300-1311.

Al-Alili A., et al., "A high efficiency solar air conditioner using concentrating photovoltaic/thermal collectors", Applied Energy 93 (2012), pp. 138-147.

Ling, J., et al., "Enhancement of the separate sensible and latent cooling air-conditioning systems", International Refrigeration and Air Conditioning Conference at Purdue, Jul. 12-15, 2010, pp. 1-11.

* cited by examiner

FLUID SYSTEM FOR HOT AND HUMID CLIMATES

GRANT OF NON-EXCLUSIVE RIGHT

This application was prepared with financial support from the Saudia Arabian Cultural Mission, and in consideration therefore the present inventor(s) has granted The Kingdom of Saudi Arabia a non-exclusive right to practice the present invention.

FIELD OF THE DISCLOSURE

Aspects of this disclosure relate to air supply systems, in particular conditioned air supply systems using a desiccant wheel to meet a sensible load.

DESCRIPTION OF THE RELATED ART

The "background" description provided herein is for the purpose of generally presenting the context of the disclosure. Work of the presently named inventors, to the extent it is described in this background section, as well as aspects of the description which may not otherwise qualify as prior art at the time of filing, are neither expressly or impliedly admitted as prior art against the present invention.

To provide conditioned air to a particular space, a typical cooling system must meet a thermal load required to produce supply air at desired conditions from outdoor air. A thermal load of the outdoor air consists of both a sensible load and a latent load. The sensible load refers to the temperature of air, and the latent load refers to the level of humidity in the air. Air conditioning units which may employ a vapor compression cycle (VCC) may be used to handle both thermal loads. Alternatively, air conditioning units can be used to handle the sensible load after the outdoor air has passed through a desiccant material. Desiccant material, which can be provided by a desiccant wheel, may be used to absorb the moisture in outdoor air to meet the latent load, leaving only the sensible load for the air conditioning unit employing the VCC.

In a system using desiccant material, in a desiccant wheel for example, the desiccant material must be continuously regenerated in order to absorb moisture from the outdoor air used to produce conditioned supply air. Heating the desiccant material releases moisture absorbed from the outdoor air, and regenerates the desiccant material. Typical desiccant systems may use a desiccant wheel in which outdoor air passes through one section, and exhaust air is passed through another section of the desiccant wheel. In the one section, moisture from the outdoor air is absorbed by the desiccant material in the desiccant wheel. In contrast, in the other section, exhaust air that has been heated, passes through the desiccant wheel. The heat of the exhaust air causes the moisture in the desiccant material to be released, and the desiccant material to be regenerated.

Exhaust air, prior to passing through a regeneration section, may be heated (i.e., provided by the regeneration heat) by an electric heater, or a condenser of an air conditioning unit which handles the sensible load. However, a need exists for a more efficient system for providing regenerating heat to a desiccant wheel.

SUMMARY

Aspects of this disclosure are directed to a heat pump which may include a compressor with a compressor inlet and a compressor outlet and an evaporator connected to the compressor inlet. The heat pump may include a first condenser with a first condenser inlet and a first condenser outlet, a second condenser with a second condenser inlet and a second condenser outlet, and a third condenser with a third condenser inlet and a third condenser outlet. The third condenser inlet may be connected to the second condenser outlet. An expansion device may be connected to the third condenser outlet, and may be connected to the evaporator upstream of the evaporator. A control valve may be provided that selectively connects the compressor outlet to the first condenser inlet, and the second condenser inlet. The second condenser inlet may be connected to the first condenser outlet when the control valve selectively connects the compressor outlet to the first condenser inlet.

In some aspects, a heat pump may be provided with an evaporator that includes one of a solar panel and a heat exchanger.

Aspects of this disclosure are directed to a fluid system that may include a heat pump including a compressor, a first condenser, a second condenser, a third condenser, an expansion device, a control valve, and an evaporator. A high temperature fluid line may be provided and may include a solar panel, a fluid tank, and at least one heat exchanger. One of the second condenser and the third condenser of the heat pump may provide heat to the fluid tank of the high temperature fluid line.

In some aspects, a heat pump of a fluid system may include a compressor that includes a compressor inlet and a compressor outlet. An evaporator may be connected to the compressor inlet and an expansion device. The heat pump may include a first condenser provided with a first condenser inlet and a first condenser outlet, a second condenser provided with a second condenser inlet and a second condenser outlet, and a third condenser provided with a third condenser inlet connected to the second condenser outlet, and a third condenser outlet connected to the expansion device. A control valve may be provided to connect to the compressor outlet, and selectively connect the compressor outlet to the first condenser inlet and the second condenser inlet.

In some aspects, a fluid system may include a heat pump with an evaporator provided by a solar panel of a high temperature fluid line, and a first connection line of the heat pump may be disposed within the solar panel. An expansion device of the heat pump may be connected to the compressor inlet of the heat pump through the first connection line.

In some aspects, a fluid system may include a first connection line for a heat pump, and at least one heat exchanger provided in a high temperature fluid line. An outlet for the heat exchanger may be connected to a fluid tank inlet through a second connection line within a solar panel of the high temperature fluid line. Heat from the solar panel of the high temperature fluid line may be absorbed by the first connection line and the second connection line.

In some aspects, a fluid system may include a second condenser of a heat pump which heats a first fluid when the first fluid is inside a fluid tank of a high temperature fluid line. At least one heat exchanger may be provided in the high temperature fluid line and may include an inlet connected to a fluid tank outlet. A first fluid may flow through the at least one heat exchanger of the high temperature fluid line, and the first fluid may flow from an outlet of the at least one heat exchanger of the high temperature fluid line through a second connection line.

In some aspects, a fluid system may include a first connection line, a second connection line, and an evaporator of a heat pump, which is provided by a fluid system heat exchanger.

In some aspects, a fluid system may include a first connection line that may connect an expansion device of a heat pump to a compressor inlet. The first connection line may include a portion within a heat pump heat exchanger. A second connection line may connect an outlet of at least one heat exchanger of a high temperature fluid line to a fluid tank inlet. The second connection line may include a first portion within the heat pump heat exchanger and a second portion within a solar panel of the high temperature fluid line.

In some aspects, a fluid system may include a first fluid that flows through at least one heat exchanger of a high temperature fluid line, then through a first portion of a second connection line, and then through a second section of the second connection. A portion of a first connection line in a fluid system heat exchanger may absorb heat from the first fluid while the first fluid is in the first portion of the second connection line. In other aspects the first fluid may absorb heat from a solar panel while in the second portion of the second connection line.

Aspects of this disclosure are directed to a cooling system that includes a desiccant wheel which may include a first section and a second section. An intake air supply may be connected to the first section of the desiccant wheel, and an exhaust air supply may be connected to the second section of the desiccant wheel. The cooling system may include a heat pump with a compressor, a first condenser, a second condenser, a third condenser, an expansion device, a control valve, and an evaporator. Further, a high temperature fluid line may be provided which includes a solar panel, a fluid tank, and at least one heat exchanger. At least one of the second condenser and the third condenser of the heat pump may provide heat to the fluid tank of the high temperature fluid line. The first condenser of the heat pump and the at least one heat exchanger of the high temperature fluid line, may be provided in the exhaust air supply upstream of the second section of the desiccant wheel, and may heat exhaust air in the exhaust air supply. The exhaust air may heat the second section of the desiccant wheel to remove moisture from intake air passing through the first section of the desiccant wheel.

In some aspects, a heat pump of a cooling system may include a compressor with a compressor inlet and a compressor outlet. An evaporator may be connected to the compressor inlet and an expansion device. The heat pump may be provided with a first condenser with a first condenser inlet and a first condenser outlet, a second condenser with a second condenser inlet and a second condenser outlet, and a third condenser with a third condenser inlet and a third condenser outlet. The third condenser inlet may be connected to the second condenser outlet, and the third condenser outlet may be connected to the expansion device. The heat pump may be provided with a control valve connected to the compressor outlet to selectively connect the compressor outlet to the first condenser inlet and the second condenser inlet.

In some aspects, a third condenser of a heat pump of a cooling system may provide low temperature heat to ambient air, a first condenser may provide high temperature heat to an exhaust air supply, and a second condenser may provide medium temperature heat to a fluid tank of a high temperature fluid line, when a control valve selectively connects a compressor outlet to a first condenser inlet. Further, a second condenser may provide high temperature heat to the fluid tank of the high temperature fluid line when the control valve selectively connects the compressor outlet to a second condenser inlet.

In some aspects, a cooling system may be provided with a control valve connected to a first condenser outlet that selectively connects the first condenser outlet to a second condenser inlet and a third condenser inlet.

In some aspects, a cooling system may be provided with at least one heat exchanger of a high temperature fluid line in an exhaust air supply, upstream of a first condenser of a heat pump.

In some aspects, an exhaust air supply of a cooling system may be provided with a main passage with an upstream end and a downstream end. The exhaust air supply may be provided with a spilt passage connected to the main passage. The split passage can be provided with a first branch passage between a first side of the downstream end and a first portion of a second section of a desiccant wheel. The split passage may be provided with a second branch passage between a second side of the downstream end and a second portion of the second section of the desiccant wheel. The first portion of the second section of the desiccant wheel may be disposed in front of the second portion along a rotational direction of the desiccant wheel. At least one heat exchanger of a high temperature fluid line may be provided in the main passage upstream of the split passage, and a first condenser of a heat pump may be included in the second branch passage.

In some aspects, a cooling system may be provided with a first portion of a second section of a desiccant wheel that is disposed in front of a second portion along a rotational direction of the desiccant wheel.

In some aspects, an exhaust air supply of a cooling system may include a main passage including an upstream end and a downstream end, and a split passage connected to the main passage. The split passage can be provided with a first branch passage between a first side of the downstream end and a first portion of a second section of a desiccant wheel. The split passage may include a second branch passage between a second side of the downstream end and a second portion of the second section of the desiccant wheel. The first portion of the second section of the desiccant wheel may be disposed in front of the second portion of the second section along a rotational direction of the desiccant wheel. At least one heat exchanger of a high temperature fluid line may be disposed in the first branch passage, and a first condenser of a heat pump may be disposed in the second branch passage.

In some aspects, an exhaust air supply of a cooling system may be provided with a main passage connected to a second section of a desiccant wheel. One heat exchanger of a high temperature fluid line, and a first condenser of a heat pump, may be located in the main passage upstream of the second section of the desiccant wheel. The one heat exchanger of the high temperature fluid line may be adjacent to the first condenser of the heat pump within the main passage of the exhaust air supply. The one heat exchanger may heat a portion of exhaust air that flows through a first portion of a second section of a desiccant wheel along a rotational direction of the desiccant wheel.

In some aspects, a cooling system may be provided with an air system heat exchanger with a first exchanger section in an intake air supply, and a second exchanger section in an exhaust air supply. An air conditioning unit may be disposed in the intake air supply. The first exchanger section may receive intake air from a first section of a desiccant wheel, and the air conditioning unit may intake air from the first exchanger section. The second exchanger section may discharge exhaust air, upstream of at least one heat exchanger of a high temperature fluid line and a first condenser of a heat pump, to a second section of a desiccant wheel.

The foregoing paragraphs have been provided by way of general introduction, and are not intended to limit the scope of the following claims. The described embodiments, together with further advantages, will be best understood by reference to the following detailed description taken in conjunction with the accompanying drawings.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF THE EMBODIMENTS

Figure 1:
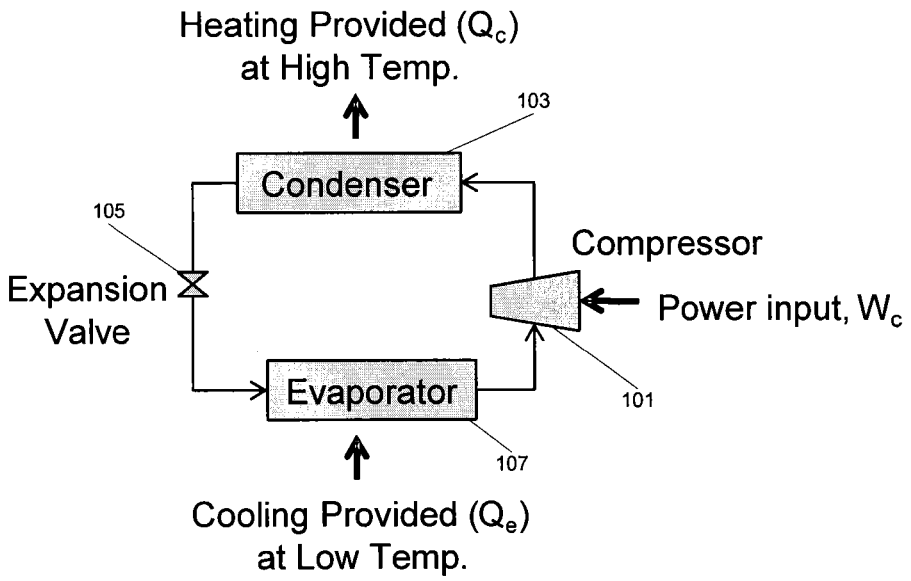
FIG. 1 illustrates a schematic diagram of a heat pump.

A fluid system according to the following disclosure may include a high temperature fluid circuit and a heat pump including staged fluid condensing. A solar energy system may be provided in the fluid system and supply heat to the heat pump and the high temperature fluid circuit, or to the high temperature fluid circuit exclusively. The fluid system may be included in a cooling system. In the cooling system, the high temperature fluid circuit and the heat pump may provide separate sources of heat for raising the temperature of air that is used for the regeneration of a desiccant wheel, which may be part of the cooling system. The heat pump may include at least three condensers that may supply heat separately to air entering the desiccant wheel, fluid in the high temperature fluid circuit, or an area where the fluid system is located.

Referring now to the drawings, wherein like reference numerals designate identical or corresponding parts throughout the several views.

FIG. 1 illustrates a schematic diagram of a heat pump 100 for a vapor compression cycle (VCC). The heat pump 100 includes a compressor 101, a condenser 103, an expansion valve 105 and an evaporator 107. During operation, power input is provided to the compressor 101 to compress refrigerant and the refrigerant's temperature is increased. The refrigerant is condensed in the condenser 103 where heat is extracted from the refrigerant at high temperature and pressure in the condenser 103. Then in the expansion valve 105, the refrigerant expands and the temperature and pressure of the refrigerant are lowered. Heat is then absorbed from the refrigerant in the evaporator 107 at a low temperature, and the refrigerant evaporates.

The energy balance for the VCC provides that heat from the condenser ($Q_c$), which is at a high temperature, is the sum of the evaporator heat ($Q_e$), which is at low temperature, and the power input to the compressor ($W_c$), that is $Q_c=W_c+Q_e$. As the refrigerant condenses, heat is radiated from the condenser 103 at a high temperature to a surrounding area. Conversely, while in the evaporator 107, the refrigerant absorbs heat from the surrounding area as evaporation occurs. The heat from the condenser 103 can be used for space heating, whereas heat absorption by the evaporator 107 can be used to extract heat at a low temperature for space cooling.

Figure 2:
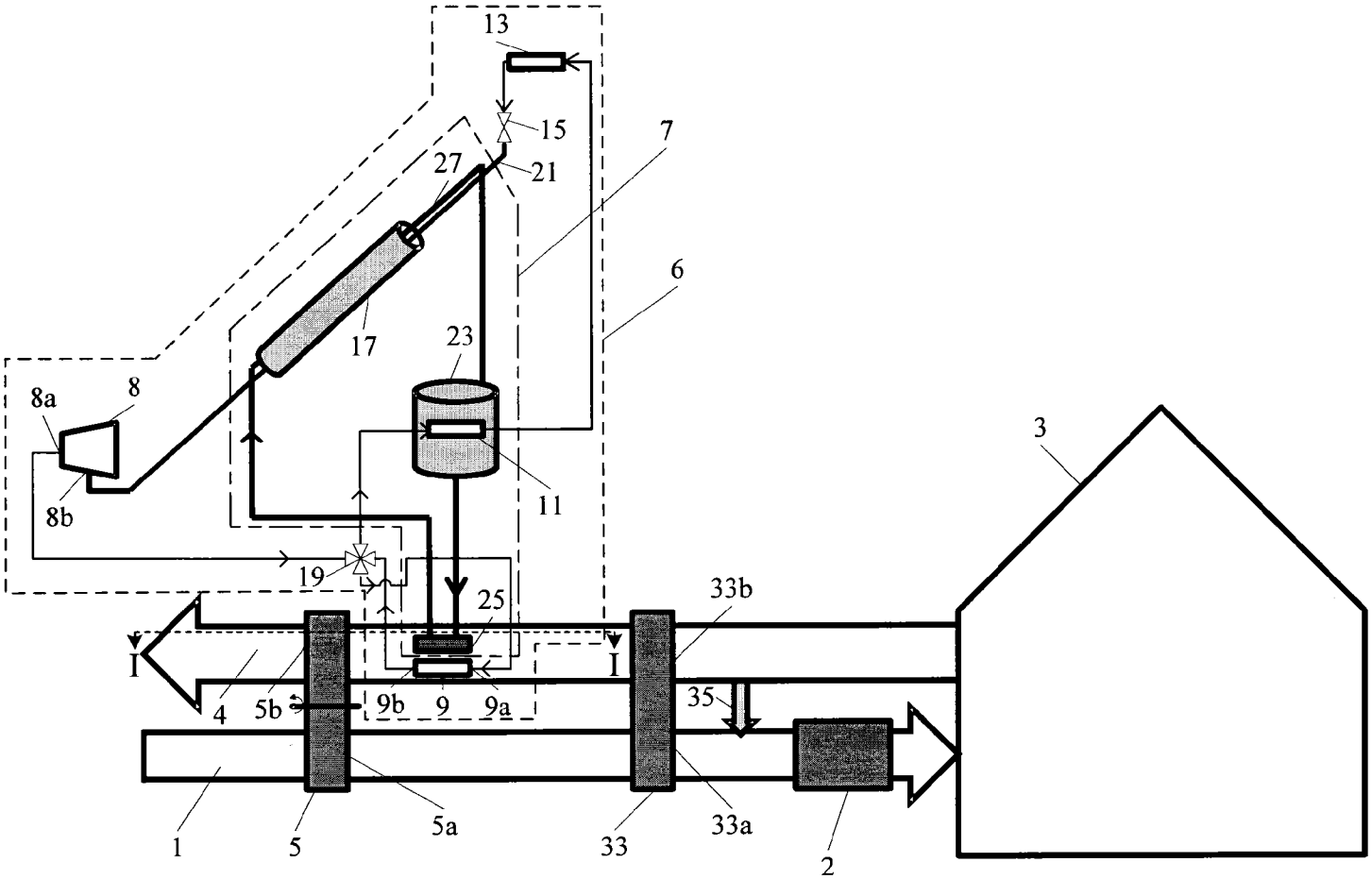
FIG. 2 illustrates a cooling system.

FIG. 2 illustrates a cooling system with an integrated fluid system that incorporates aspects of a staged heat pump 6, in combination with a high temperature fluid circuit 7, to improve operational efficiency of a desiccant wheel 5.

In the cooling system illustrated in FIG. 2, outdoor air is introduced through an air intake passage 1 to an air conditioning unit 2, and then supplied to a space 3 where conditioned air is desired. The space 3 may be a house or other space requiring conditioned air. Prior to being supplied to the air conditioning unit 2, the outdoor air passes through the desiccant wheel 5. The desiccant wheel 5 is provided to meet the latent load of the total cooling load required for the space (i.e. to reduce the humidity of the air being supplied to the air conditioning unit 2, in order to reach a desired wet bulb temperature), and includes a rotating wheel of desiccant material. As the wheel turns, moisture will be absorbed from air passing through sections of the desiccant wheel 5 in which desiccant material has been regenerated.

Desiccant material is regenerated when heated. In the cooling system illustrated in FIG. 2, the outdoor air is directed through a moisture absorption section 5*a* of the desiccant wheel 5. Heating the desiccant material in the desiccant wheel 5 before it rotates through the moisture absorption section 5*a*, provides regenerated desiccant material which absorbs moisture from the outdoor air passing through the moisture absorption section 5*a*. To provide regenerated desiccant material in the moisture absorption section 5*a*, heat is supplied to a regenerating section 5*b*.

Once supplied to the space 3, air is exhausted through an exhaust passage 4, which directs the exhaust air through the regenerating section 5*b* of the desiccant wheel 5. The exhaust air, if hot enough, will regenerate the desiccant material rotating through regenerating section 5*b*, before it rotates through the moisture absorption section 5*a*. In the cooling system illustrated in FIG. 2, a staged heat pump 6, and a high temperature fluid circuit 7 heat the exhaust air passing through the regenerating section 5*b*, which causes the desiccant material rotating in the regenerating section 5*b* to release moisture and be regenerated.

The staged heat pump 6 includes a compressor 8, a first condenser 9, a second condenser 11, a third condenser 13, an expansion valve 15, a switch valve 19, and an evaporator line 21. In operation, refrigerant is compressed in the compressor 8 and enters the first condenser 9 at a high temperature and pressure. The first condenser 9 is arranged in the exhaust passage 4 and provides high temperature heat. As exhaust air passes over the first condenser 9, heat is extracted from the refrigerant in the first condenser 9 and absorbed by the exhaust air. The temperature of the exhaust air that passes over the first condenser 9 increases, while the temperature of the refrigerant is reduced.

Once the refrigerant goes through the first condenser 9 and the switch valve 19, it is supplied to the second condenser 11. The second condenser is located within a fluid heating tank 23 of the high temperature fluid circuit 7. Fluid surrounding the second condenser 11 within the fluid heating tank 23, absorbs medium temperature heat extracted from the refrigerant in the second condenser 11. The temperature of the fluid increases while the temperature of the refrigerant in the second condenser 11 is lowered. From the second condenser 11, the refrigerant flows into the third condenser 13 in which completion of the staged condensing occurs and the refrigerant supplies low temperature heat to the ambient air surrounding the third condenser 13.

The refrigerant flows from the third condenser 13 to an expansion valve 15 where the refrigerant expands, further lowering its temperature and pressure. Then in the evaporator line 21, the refrigerant absorbs heat and evaporates. While the temperature and pressure of the refrigerant in the evaporator line 21 increases, the absorption of heat from the area surrounding the evaporator line 21 provides space cooling. From the evaporator line 21, the refrigerant is flowed to the compressor 8 to be compressed.

As illustrated in FIG. 2, the integrated fluid system used to improve the efficiency of the desiccant wheel 5 includes the high temperature fluid circuit 7. The high temperature fluid circuit 7 includes the fluid heating tank 23 in which the second condenser 11 of the staged heat pump 6 is arranged, a heat exchanger 25, and a low temperature fluid line 27. Fluid in the fluid heating tank 23 is heated by the heat that is extracted from the refrigerant in the second condenser 11. In this way the fluid in the fluid heating tank 23 provides a heat sink that absorbs heat from the second condenser 11, and aids in the condensing of the refrigerant in the staged heat pump 6. Then, the fluid travels from the fluid heating tank 23 to the heat exchanger 25 which is arranged in the exhaust passage 4 of the cooling system. Once in the heat exchanger 25, the fluid from the fluid heating tank 23 provides medium temperature heat which heats the air in the exhaust passage 4 before the air reaches the desiccant wheel 5. As the air surrounding the heat exchanger 25 absorbs heat from the fluid, the temperature of the fluid is reduced. From the heat exchanger, the fluid flows through the low temperature fluid line 27 and to the fluid heating tank 23.

The staged heat pump 6 and the high temperature fluid circuit 7 are integrated by providing the evaporator line 21 and the low temperature line 27 inside of the solar panel 17, arranging the second condenser 11 within the fluid heating tank 23, and the operation of the switch valve 19.

The solar panel 17 provides a source of power and serves as an evaporator for the staged heat pump 6. As the solar panel 17 operates to absorb sunlight and provide a source of power, the temperature of the solar panel 17 increases. In order to maximize the efficient operation of the solar panel 17, it is desirable to lower the temperature of the solar panel 17. The refrigerant in the evaporation line 21 of the staged heat pump 6, and the fluid in the low temperature line 27 of the high temperature fluid circuit 7, absorb heat and thus provide a combined heat sink within the solar panel 17. The evaporation line 21 and the low temperature line 27 therefore aid in lowering the temperature of the solar panel 17. The heat absorbed by the refrigerant in the evaporator line 21 raises the temperature of the refrigerant, so that the refrigerant evaporates before reaching the compressor 8. The solar panel 17 is therefore the functional equivalent of an evaporator. In an alternative fluid system, a separate evaporator for a heat pump may be provided that cools air used to cool a solar energy system which may include the solar panel 17.

With respect to the second condenser 11 being within the fluid heating tank 23, the arrangement may serve two functions. The first function being to provide high temperature fluid, heated by the second condenser 11 and by the solar panel 17, from the fluid heating tank 23 to the heat exchanger 25 within the exhaust passage 4. The heat exchanger 25, in turn heats the air in the exhaust air passage 4 which will aid in regenerating the desiccant material in the desiccant wheel 5, as the desiccant material rotates through the regenerating section 5*b*. The second function is tied to the ability to use the high temperature fluid for other purposes. When the fluid in the fluid heating tank is water, a portion of the high temperature fluid can be supplied from the fluid heating tank 23 and used in domestic hot water applications.

The operation of the switch valve 19 will now be described. The staged heat pump 6 is provided with the switch valve 19, which can be operated to place the compressor 8 in fluid communication with the first condenser 9, or the second condenser 11. During normal operation, the switch valve 19 provides a fluid connection between a compressor outlet 8*a* and a first condenser inlet 9*a*, and a fluid connection between a first condenser outlet 9*b* and the second condenser 11. However, the switch valve 19 can be operated to stop the flow of fluid to the first condenser 9 for certain operating conditions when temperature of the refrigerant flowing from the compressor outlet 8*a* does not meet operational requirements. Under these operating conditions the switch valve 19 is operated to provide a fluid connection between the compressor outlet 8*a* and the second condenser 11, and the fluid connection between the first condenser outlet 9*b* and the second condenser 11 is shut off. The operating conditions in which the fluid connection from the compressor outlet 8*a* to the first condenser inlet 9*a* is shut off may depend on the temperature of air needed to regenerate the desiccant material of the desiccant wheel 5, and the arrangement of the first condenser 9 and the heat exchanger 25 within the exhaust air passage 4. In addition, the operating conditions in which the compressor outlet 8*a* is in fluid communication with the second condenser 11, may be independent of the regeneration of the desiccant material of the desiccant wheel 5. As discussed above, the fluid in the high temperature fluid 7 may be used for domestic hot water applications. A situation may occur in which a supply of hot water needs to be supplemented, or an existing domestic water system is unable to provide water at a required temperature. By operation of the switch valve 19, refrigerant at a high temperature from the compressor 8 can be provided to the second condenser 11 to heat the water in the fluid heating tank 23 to a desired temperature. The water may then be provided to the existing domestic water system as required.

In addition to the switch valve 19, a second control valve and bypass line may be provided between the first condenser outlet 9*b* and a third condenser inlet. The second control valve may selectively control the amount of flow to the second condenser by providing a bypass to the third condenser 13. In situations where the temperature of the refrigerant leaving first condenser 9 is less than the temperature of the fluid flowing in the low temperature line 27 to the fluid heating tank 23, the refrigerant would absorb heat from the fluid in the fluid heating tank 23 and lower the temperature of the fluid. In order to avoid this reduction in temperature, the second control valve can be used to direct refrigerant to the inlet of the third condenser 13, and bypass the second condenser 11. However, if the temperature of the refrigerant leaving first condenser 9 is greater than the temperature of the fluid flowing in the low temperature line 27 to the fluid heating tank 23, the second control valve will not be operated which makes the refrigerant go to the second condenser 11.

In the cooling system illustrated in FIG. 2, the first condenser 9 of the staged heat pump 6 is a source of high temperature heat, and the heat exchanger 25 of the high temperature fluid circuit 7 is a source of medium temperature heat to the air in the exhaust air passage 4. The first condenser 9 and the heat exchanger 25 can be arranged in several configurations within the exhaust air passage 4 as illustrated in FIGS. 3*a-d*.

In FIG. 2, the first condenser 9 and the heat exchanger 25 are shown in the exhaust air passage 4 schematically, however in an actual configuration the first condenser 9 and the heat exchanger 25 would be arranged in the same plane intersecting a vertical axis. In an overhead cross-sectional view from line I-I, as illustrated in FIG. 2, FIGS. 3*a-d* illustrate different configurations for the first condenser 9 and the heat exchanger 25 within the exhaust air passage 4.

Figure 3A:
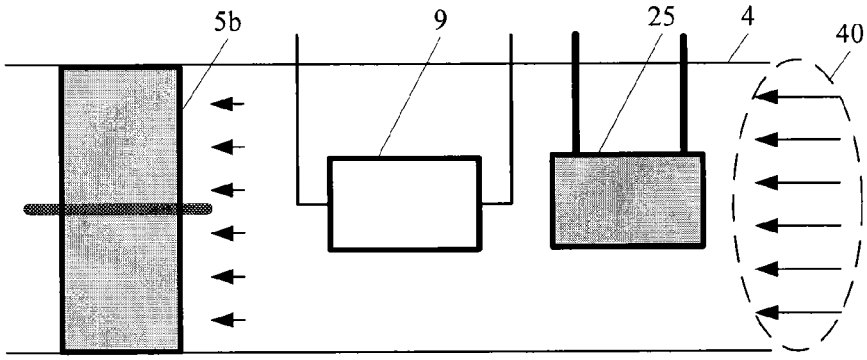
FIGS. 3*a-d* each illustrate a cross-sectional view along Line I-I of FIG. 1 of an exhaust air passage configuration.

FIG. 3*a* illustrates a single air stream configuration in which an air stream 40 in the exhaust air passage 4 is preheated by the heat exchanger 25 before reaching the first condenser 9. The heat exchanger 25 and the first condenser 9 are arranged in succession along the flow of the air stream 40. In this configuration, the air stream 40 absorbs medium temperature heat from the heat exchanger 25 so that its temperature is increased before reaching the first condenser 9. The high temperature heat absorbed from the first condenser 9 therefore has to raise the temperature of the air by a smaller margin, in order to be at an adequate temperature for regeneration of the desiccant material. In this configuration, the temperature of the air stream 40 over a cross section of the regenerating section 5*b*, between the walls of the exhaust air passage 4 illustrated in FIGS. 3*a-d*, is relatively the same.

Figure 3B:
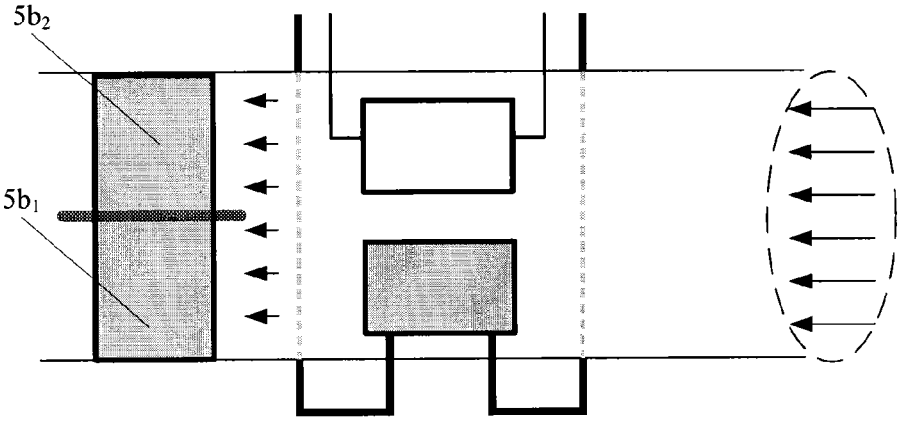

FIG. 3*b* illustrates a single air stream configuration in which the temperature of the air stream 40 is not uniform over the cross-section of the regenerating section 5*b* between the walls of the exhaust air passage 4. In the configuration illustrated in FIG. 3*b*, the heat exchanger 25 is arranged next to the first condenser 9 across the exhaust air passage 4. As a result, the portion of the air stream 40 that passes the heat exchanger 25 will absorb medium temperature heat, and the portion of the air stream 40 that passes the first condenser 9 will absorb high temperature heat.

Figure 4:
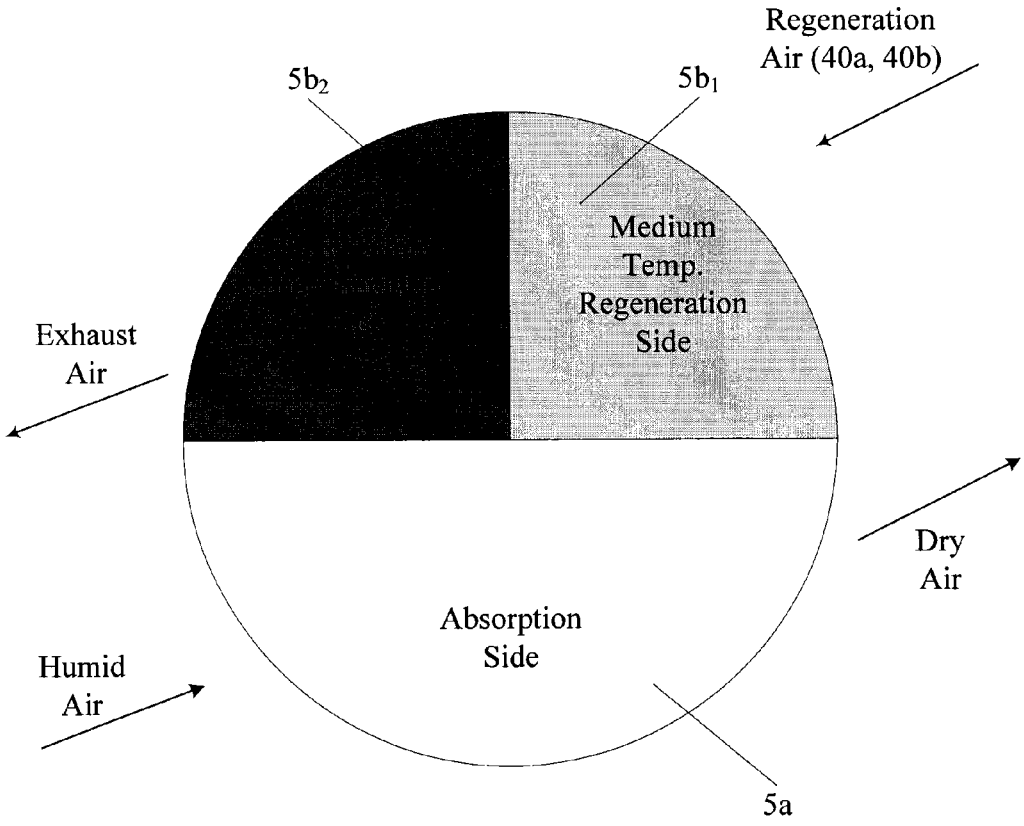
FIG. 4 illustrates a schematic diagram of a desiccant wheel.

In the configuration of FIG. 3*b*, the regenerating section 5*b* of the desiccant wheel 5 is split into two regenerating sections of the desiccant wheel 5. As illustrated in FIG. 4, a first regenerating sub-section $\mathbf{5}b_1$ of the regenerating section 5*b* along the rotational direction of the desiccant wheel 5, is exposed to medium temperature heat via the portion of the air stream 40 passing the heat exchanger 25. A second regenerating sub-section $\mathbf{5}b_2$ along the rotational direction of the desiccant wheel 5, is exposed to high temperature heat via the portion of the air stream 40 passing the first condenser 9. As the desiccant wheel rotates, the desiccant material in any given segment of the desiccant wheel 5 will first be heated by the portion of the air stream 40 that absorbed medium temperature heat from the heat exchanger 25. As the desiccant wheel 5 rotates, the given segment of desiccant material previously heated by the portion of the air stream 40 passing the heat exchanger 25, is heated by the portion of the air stream 40 that has absorbed high temperature heat from the first condenser 9. In effect, the desiccant material is preheated by air passing the heat exchanger 25, and then heated to a high temperature by air that passes the first condenser 9.

Figure 3C:
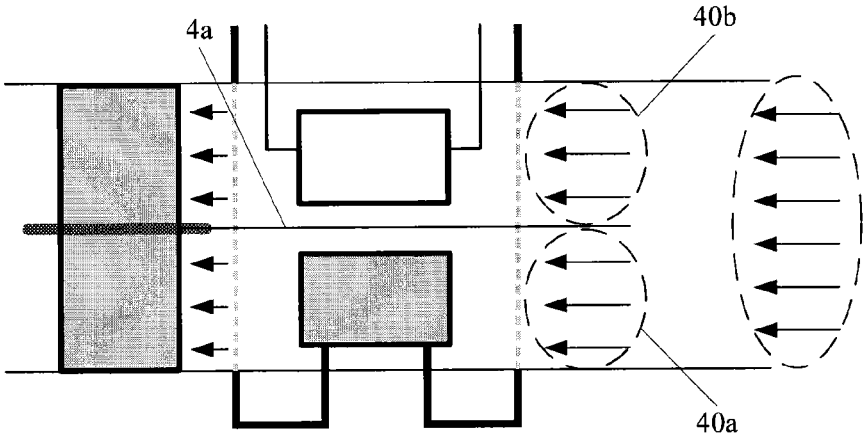

The configuration of FIG. 3*c* is the same as that of FIG. 3*b*, with the exception of the addition of an exhaust partition 4*a* to the exhaust air passage 4. The exhaust partition 4*a* extends between the first condenser 9 and the heat exchanger 25, from a location along the flow of the air stream 40 before the first condenser 9 and the heat exchanger 25, to the desiccant wheel 5. The exhaust partition 4*a* splits the air exhaust passage 4 into two passages, and provides a physical barrier that defines the regenerating sub-sections ($\mathbf{5}b_1$, $\mathbf{5}b_2$) of the desiccant wheel 5 that make up the regenerating section 5*b*. As a result of the exhaust partition 4*a*, the air stream 40 is spilt into a first stream 40*a* and a second stream 40*b*, prior to passing over the heat exchanger 25 and the first condenser 9, respectively.

Figure 3D:
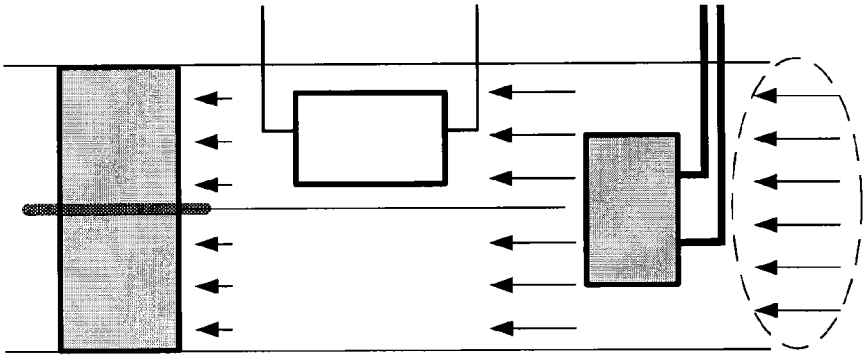

FIG. 3*d* illustrates a configuration for the first condenser 9 and the heat exchanger 25 that combines the benefits of the configuration illustrated in FIG. 3*a*, with the benefits of the configurations of FIGS. 3*b* and 3*c*. In the configuration of FIG. 3*d*, the air stream 40 passes the heat exchanger 25 before being divided into the first stream 40*a* and the second stream 40*b*. With the provision of the exhaust partition 4*a*, the first stream 40*a* which absorbed medium temperature heat from the heat exchanger 25 is directed to the first regenerating sub-section $\mathbf{5}b_1$. The second stream 40*b*, like the first stream 40*a*, has previously absorbed medium temperature heat from the heat exchanger 25. The second stream 40*b* then absorbs heat from the first condenser 9 and flows to the second regenerating sub-section $\mathbf{5}b_2$. Thus in the configuration of FIG. 3*d*, the second stream 40*b* is preheated by the heat exchanger similar to the single air stream 40 in the configuration of FIG. 3*a*, and is then heated by the condenser. The temperature differential required to raise the second stream to an adequate temperature for regeneration, is smaller than it would be for air that passes directly from the space 3 to the first condenser 9, and through the exhaust air passage 4 to the desiccant wheel 5.

One advantage of the fluid system of this disclosure is that a separate electric heater provided in an exhaust passage is not needed to provide air at an adequate temperature for desiccant regeneration. The fluid system illustrated in FIG. 2 also provides several advantages that result in operational efficiencies, specifically with respect to a solar panel, a desiccant wheel, and an air conditioning unit. As discussed above during operation, a solar panel is cooled by an evaporator line and a low temperature line. Solar panels operate more efficiently at lower temperatures. The solar panel may also be used to supply electricity, thus in this situation when the solar panel operates at a low temperature, electricity is produced by the solar panel more efficiently. Different types of solar energy systems including flat plate PV/T panels, CPVT, evacuated tube collectors, etc., may also be used for the solar panel, and operated at lower temperatures which may result in operational efficiencies.

Coincident to the efficient operation of the solar panel, is the efficient operation of a desiccant wheel. While low temperature fluid is provided to absorb heat and lower the temperature of the solar panel during operation, the desiccant operates more efficiently at a higher temperature due to the heat supplied by exhaust air passing over a high temperature condenser and a heat exchanger in an exhaust passage.

The fluid system of this disclosure also has advantages over air conditioning systems which use a condenser of an air conditioning unit to heat air supplied to a desiccant wheel as regeneration air. The fluid system of this disclosure uses a heat pump to provide regeneration air, which is more efficient than the condenser of the air conditioning unit, because the temperature lift of the heat pump (e.g. 30° C. of a solar panel to a 90° C. desiccant regeneration temperature) is less than a temperature lift of the air conditioning unit (e.g. 10° C. for a cooling supply air temperature to a 90° C. desiccant regeneration temperature). In addition, using the condenser may reduce the efficiency of the operation of the air conditioning unit since the temperature of the condenser has to be raised more to provide regeneration air than is required just to provide conditioned air. This increases the power consumption and reduces the operational efficiency of the air conditioning unit.

Figure 5:
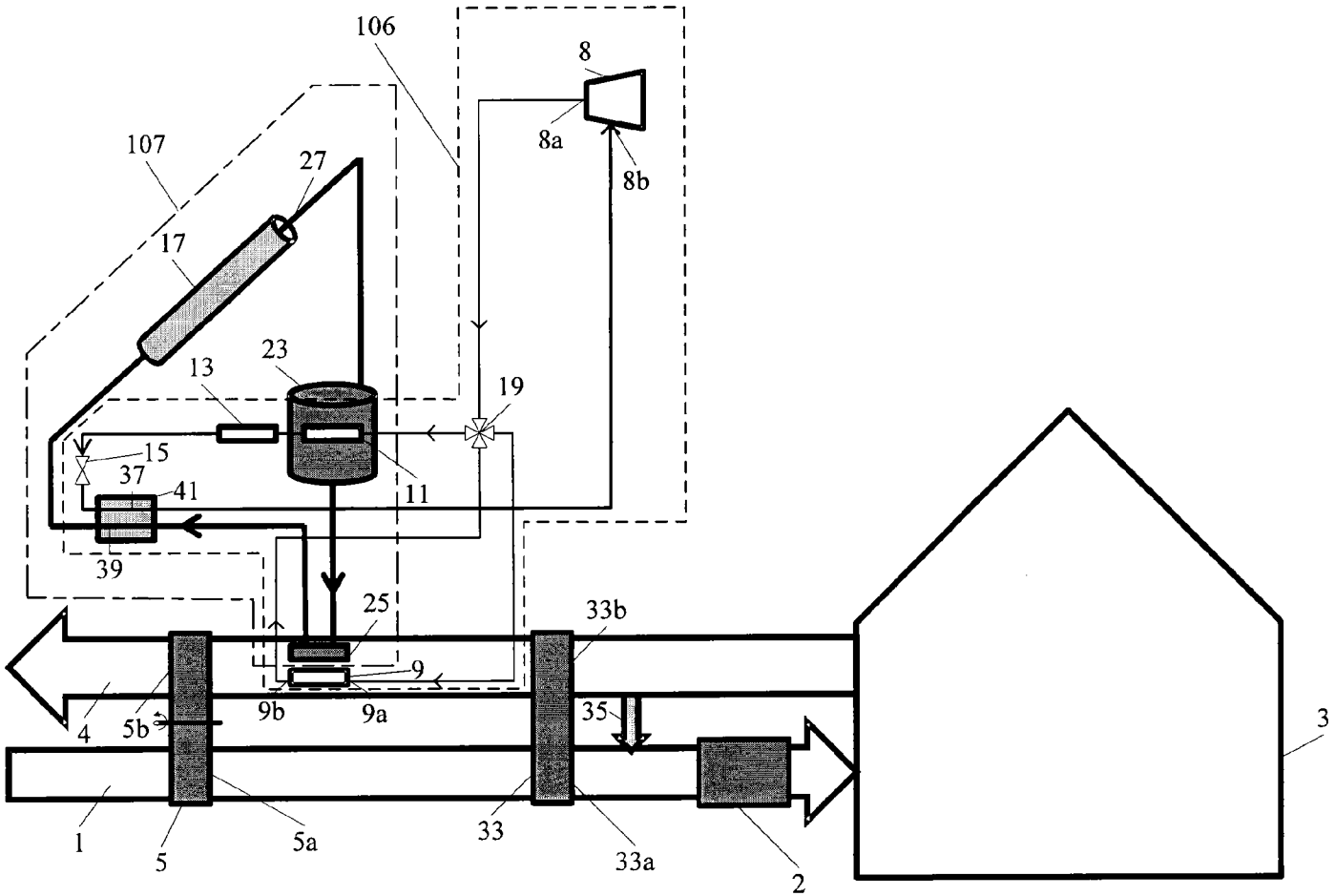
FIG. 5 illustrates a cooling system.

In FIG. 5, elements thereof equivalent to those shown in FIG. 2 are given like reference numeral designations. FIG. 5 illustrates a cooling system with an integrated fluid system that incorporates aspects of a staged heat pump 106, in combination with a high temperature fluid circuit 107, to improve the efficient operation of the desiccant wheel 5.

The staged heat pump 106 includes the compressor 8, the first condenser 9, the second condenser 11, the third condenser 13, the expansion valve 15, the switch valve 19, and an evaporator line 37. In operation refrigerant is compressed in compressor 8 and enters the first condenser 9 at a high temperature and pressure. The first condenser 9 is arranged in the exhaust passage 4 and provides high temperature heat. As exhaust air passes over the first condenser 9, heat is extracted from the refrigerant in the first condenser 9 and absorbed by the exhaust air. The temperature of the exhaust air that passes over the first condenser 9 increases, while the temperature of the refrigerant is reduced. The cooling system includes an air-to-air heat exchanger 33 including a bottom portion 33*a* disposed in the air intake passage 1, and an upper portion 33*b* disposed in the exhaust passage 4. The cooling system also provisions the recirculation of air 35 from the exhaust passage 4 to the air intake passage 1.

Once the refrigerant goes through the first condenser 9 and the switch valve 19, it is supplied to the second condenser 11. The second condenser 11 is located within the fluid heating tank 23 of the high temperature fluid circuit 107. Fluid surrounding the second condenser 11 within the fluid heating tank 23, absorbs medium temperature heat extracted from the refrigerant in the second condenser 11. The temperature of the fluid increases while the temperature of the refrigerant in the second condenser 11 is lowered. From the second condenser 11, the refrigerant flows into the third condenser 13 in which completion of the condensing occurs and the refrigerant supplies low temperature heat to the ambient air surrounding the third condenser 13.

The refrigerant flows from the third condenser 13 to an expansion valve 15 where the refrigerant expands, which lowers its temperature and pressure. Then in the evaporator line 37, the refrigerant absorbs heat and evaporates. The evaporator line 37 is provided in an integrated heat exchanger 41. While the temperature of the refrigerant in the evaporator line 37 increases, the absorption of heat from the area surrounding the evaporator line 37 provides cooling to the fluid temperature reduction line 39, which will cool the solar panel 17. From the evaporator line 37, the refrigerant is flowed to the compressor 8 to be compressed.

As illustrated in FIG. 5, the integrated fluid system used to improve the efficiency of the desiccant wheel 5 includes the high temperature fluid circuit 107. The high temperature fluid circuit 107 includes the fluid heating tank 23 in which the second condenser 11 of the staged heat pump 106 is arranged, the heat exchanger 25, and the low temperature fluid line 27. Fluid in the fluid heating tank 23 is heated by the heat that is extracted from the refrigerant in the second condenser 11. In this way, the fluid in the fluid heating tank 23 provides a heat sink that absorbs heat from the second condenser 11 and aids in the condensing of the refrigerant in the staged heat pump 106.

The fluid travels from the fluid heating tank 23 to the heat exchanger 25 which is arranged in the exhaust passage 4 of the cooling system. Once in the heat exchanger 25, the fluid from the fluid heating tank 23 provides medium temperature heat which heats the air in the exhaust passage 4 before the air reaches the desiccant wheel 5. As the air surrounding the heat exchanger 25 absorbs heat from the fluid, the temperature of the fluid is reduced. From the heat exchanger 25 the fluid flows through a fluid temperature reduction line 39 that extends through the integrated heat exchanger 41.

As with the integrated fluid system illustrated in FIG. 2, the staged heat pump 106 and the high temperature fluid circuit 107 are integrated with the arrangement of the second condenser 11 within the fluid heating tank 23, and the operation of the switch valve 19. The switch valve 19 in the cooling system illustrated in FIG. 5 can be operated under the same operation scheme used for the cooling system illustrated in FIG. 2. In addition, a second control valve and bypass line can be provided between the first condenser outlet 9*b* and a third condenser inlet.

However, while the low temperature line 27 is still provided within the solar panel 17 in the cooling system of FIG. 5, an evaporator line is not integrated into the solar panel 17. In the cooling system of FIG. 5, the staged heat pump 106 and the high temperature fluid circuit 107 are integrated with the integrated heat exchanger 41. As refrigerant, having been finally condensed in the third condenser 13 and expanded in the expansion valve 15, passes through the evaporator line 37 within the integrated heat exchanger 41, it absorbs heat extracted from the fluid in the temperature reduction line 39. Conversely the fluid in the temperature reduction line 39 acts as an evaporator. The heat extracted from the fluid in the temperature reduction line 39 is absorbed by the refrigerant in the evaporator line 37, and the temperature of the refrigerant is raised to the point that the refrigerant evaporates before reaching the compressor 8.

In the cooling system illustrated in FIG. 5, the solar panel 17 provides a source of power but does not serve as an evaporator for the staged heat pump 106. There is no evaporator line within the solar panel 17 to combine with the fluid in the low temperature fluid line 27, and provide a combined heat sink to absorb heat. In order to lower the temperature and maximize the efficient operation of the solar panel 17, the temperature of the fluid in the low temperature fluid line 27 must be lower in the cooling system of FIG. 5, than the cooling system of FIG. 2. The fluid in the high temperature fluid circuit 107 is cooled before flowing through the low temperature line 27. The evaporator line 37 functions to cool the fluid in the temperature reduction line 39 before flowing through the low temperature fluid line 27 within the solar panel 17. The fluid in the low temperature line 27, cooled in temperature reduction line 39 by the evaporator line 37 within the integrated heat exchanger 41, absorbs heat and thus provides a sufficient heat sink to decrease the temperature, and in turn increase the efficiency, of the solar panel 17.

Like the cooling system illustrated in FIG. 2, in the cooling system of FIG. 5, the first condenser 9 of the staged heat pump 106 is a source of high temperature heat, and the heat exchanger 25 of the high temperature fluid circuit 107 is a source of medium temperature heat to the air in the exhaust air passage 4. The configurations for the first condenser 9 and the heat exchanger 25 illustrated in FIGS. 3*a-d*, apply to the cooling system illustrated in FIG. 5.

The fluid system of FIG. 5 provides the same operational efficiencies associated with fluid system illustrated in FIG. 2. In addition, a solar panel, or solar energy system of the types described herein, may only be integrated into a high temperature fluid circuit. A solar energy system may be more easily integrated into the fluid system, and replaced in the event of failure. It is also noted that if the chosen solar energy system needs to be replaced, the heat pump in the fluid system of FIG. 5 may still be operated to heat water in a fluid heating tank and provide domestic hot water.

Various modifications to the fluid systems described herein fall within the scope of this disclosure and include, but are not limited to, adding a liquid vapor separator downstream of evaporators, a suction line heat exchanger upstream of a compressor, or more compression stages with or without intercooling. In addition, expanders can be used in place of expansion valves, return air can be cooled by supply air or a dehumidifier, and different refrigerants may be used in a heat pump as described. Further, the described cooling system can be applied with a liquid desiccant system as a dehumidification source. Modes of operation may also be modified, for example the fluid systems described herein may operate in common heating modes. For this mode of operation, one condenser may provide heat to supply air. In addition, it is noted that, as used in the specification and the appended claims, the singular forms "a," "an," and "the" include plural referents unless the context clearly dictates otherwise.

Thus, the foregoing discussion discloses and describes merely exemplary embodiments of the present invention. As will be understood by those skilled in the art, the present invention may be embodied in other specific forms without departing from the spirit or essential characteristics thereof. Accordingly, the disclosure of the present invention is intended to be illustrative, but not limiting of the scope of the invention, as well as other claims. The disclosure, including any readily discernible variants of the teachings herein, define, in part, the scope of the foregoing claim terminology such that no inventive subject matter is dedicated to the public.

The invention claimed is:

1. A cooling system comprising:

a desiccant wheel including a first section and a second section;

an intake air supply connected to the first section of the desiccant wheel;

an exhaust air supply connected to the second section of the desiccant wheel;

a heat pump including a compressor, a first condenser, a second condenser, a third condenser, an expansion device, a control valve, and an evaporator; and a high temperature fluid line circuit including a solar panel, a fluid tank, and at least one heat exchanger, wherein in a first mode of operation of the cooling system, the control valve is adapted to connect a compressor outlet to a series connection of the first condenser, the second condenser, and the third condenser, and wherein in a second mode of operation of the cooling system, the control valve is adapted to bypass the first condenser and connect the compressor outlet to a series connection of the second condenser and the third condenser, the first condenser of the heat pump and the at least one heat exchanger of the high temperature fluid line circuit are provided in the exhaust air supply upstream of the second section of the desiccant wheel to heat exhaust air in the exhaust air supply, and the exhaust air heats the second section of the desiccant wheel to remove moisture from intake air passing through the first section of the desiccant wheel, wherein the compressor includes a compressor inlet and the compressor outlet, the evaporator is connected to the compressor inlet and the expansion device, the first condenser includes a first condenser inlet and a first condenser outlet, the second condenser includes a second condenser inlet and a second condenser outlet, and the third condenser includes a third condenser inlet connected to the second condenser outlet and a third condenser outlet connected to the expansion device, and wherein the first condenser provides heat having a first temperature to the exhaust air supply and the second condenser provides heat having a second temperature to the fluid tank of the high temperature fluid line circuit in the first mode of operation of the cooling system, the second condenser provides heat of the first temperature to the fluid tank of the high temperature fluid line circuit in the second mode of operation of the cooling system, and the third condenser provides heat having a third temperature to ambient air.

2. The cooling system of claim 1, further comprising:

a second control valve connected to the first condenser outlet that selectively connects the first condenser outlet to the second condenser inlet and the third condenser inlet.

3. The cooling system of claim 1, wherein the at least one heat exchanger of the high temperature fluid line circuit is provided in the exhaust air supply upstream of the first condenser of the heat pump.

4. The exhaust air supply of the cooling system of claim 3, further comprising:

a main passage including an upstream end and a downstream end;

a split passage connected to the main passage including a first branch passage between a first side of the downstream end and a first portion of the second section of the desiccant wheel, and a second branch passage between a second side of the downstream end and a second portion of the second section of the desiccant wheel, wherein the at least one heat exchanger of the high temperature fluid line circuit is provided in the main passage upstream of the split passage, and the first condenser of the heat pump is provided in the second branch passage.

5. The cooling system of claim 4, wherein the first portion of the second section of the desiccant wheel is disposed in front of the second portion along a rotational direction of the desiccant wheel.

6. The exhaust air supply of the cooling system of claim 1, further comprising:

a main passage;

a split passage including an upstream end connected to the main passage and a downstream end;

a first branch passage between a first side of the downstream end and a first portion of the second section of the desiccant wheel;

a second branch passage between a second side of the downstream end and a second portion of the second section of the desiccant wheel, wherein the first portion of the second section of the desiccant wheel is disposed in front of the second portion along a rotational direction of the desiccant wheel, the at least one heat exchanger of the high temperature fluid line circuit is provided in the first branch passage, and the first condenser of the heat pump is provided in the second branch passage.

7. The exhaust air supply of the cooling system of claim 1, further comprising a main passage connected to the second section of the desiccant wheel, wherein the at least one heat exchanger of the high temperature fluid line circuit and the first condenser of the heat pump are provided in the main passage upstream of the second section of the desiccant wheel, wherein the at least one heat exchanger of the high temperature fluid line circuit is adjacent to the first condenser of the heat pump within the main passage and heats a portion of the exhaust air that flows through a first portion of the second section of the desiccant wheel along a rotational direction of the desiccant wheel.

8. The cooling system of claim 1 further comprising:

an air system heat exchanger including a first exchanger section in the intake air supply and a second exchanger section in the exhaust air supply; and an air conditioning unit in the intake air supply, wherein the first air section receives intake air from the first section of the desiccant wheel and the air conditioning unit intakes intake air from the first air section, and the second air section discharges exhaust air to the second section of the desiccant wheel upstream of the at least one heat exchanger of the high temperature fluid line circuit and the first condenser of the heat pump.

* * * * *